US007073738B2

(12) United States Patent
Sneeringer et al.

(10) Patent No.: US 7,073,738 B2
(45) **Date of Patent: *Jul. 11, 2006**

(54) FINE MEDIA MILL WITH IMPROVED DISC

(75) Inventors: John R. Sneeringer, Reading, PA (US); Charles MacNeall, Reading, PA (US)

(73) Assignee: Premier Mill Corporation, Reading, PA (US)

( * ) Notice: Subject to any disclaimer, the term of this patent is extended or adjusted under 35 U.S.C. 154(b) by 72 days.

This patent is subject to a terminal disclaimer.

(21) Appl. No.: 10/913,423

(22) Filed: Aug. 9, 2004

(65) Prior Publication Data

US 2005/0011976 A1 Jan. 20, 2005

Related U.S. Application Data

(63) Continuation of application No. 10/169,867, filed on Oct. 3, 2002, now Pat. No. 6,808,136.

(51) Int. Cl.
*B02C 17/00* (2006.01)

(52) U.S. Cl. ..... 241/30; 241/172; 241/296

(58) Field of Classification Search ..... 241/172, 241/21, 30, 46.11, 46.17; 366/317, 341
See application file for complete search history.

(56) References Cited

U.S. PATENT DOCUMENTS

| | | | | |
|---|---|---|---|---|
| 1,673,927 | A | 6/1928 | Turner | |
| 2,639,901 | A | 5/1953 | Teale | |
| 3,486,705 | A * | 12/1969 | Szegvari | 241/172 |
| 3,706,314 | A | 12/1972 | Smith, Jr. | |
| 4,066,215 | A | 1/1978 | Pujol | |
| 4,082,231 | A | 4/1978 | Gould | |
| 4,269,363 | A | 5/1981 | Entzmann | |
| 4,580,736 | A | 4/1986 | Takahashi et al. | |
| 4,811,909 | A | 3/1989 | Inoki | |
| 4,983,046 | A | 1/1991 | Murata et al. | |
| 5,333,804 | A | 8/1994 | Liebert | |
| 5,947,599 | A | 9/1999 | Funk | |
| 6,808,136 | B1 * | 10/2004 | Sneeringer et al. | 241/172 |

FOREIGN PATENT DOCUMENTS

| | | |
|---|---|---|
| DE | 2154059 | 5/1973 |
| GB | 1084731 | 9/1967 |
| WO | WO 01/51212 A1 | 7/2001 |

OTHER PUBLICATIONS

International Search Report for International Application No. PCT/US01/00716, dated Feb. 21, 2001, published on Jul. 19, 2001 under No. WO 01/51212.

Supplementary European Search Report for Application No. 01942330.0-2316-US0100716, dated Jan. 31, 2003, published on Feb. 13, 2003.

* cited by examiner

*Primary Examiner*—Mark Rosenbaum
(74) *Attorney, Agent, or Firm*—Baker & Hostetler LLP

(57) ABSTRACT

An agitator with a rotatable axial shaft with a plurality of grinding discs connected generally perpendicular to the shaft is provided having at least one grinding disc with an axially extending pin spaced radially outwardly from the shaft and radially inwardly from a peripheral edge of the disc. The pin is aligned with a smooth surface on a next adjacent disc.

27 Claims, 5 Drawing Sheets

FINE MEDIA MILL WITH IMPROVED DISC

This application is a continuation application, and claims the benefit of U.S. patent application Ser. No. 10/169,867, filed Oct. 3, 2002, now U.S. Pat. No. 6,808,136 entitled FINE MEDIA MILL WITH IMPROVED DISC, the disclosure of which is incorporated herein by reference.

BACKGROUND

The present invention is directed to an agitator or media mill used to grind or deagglomerate a product in a carrier medium using a grinding media and, in particular, to an improved agitator mill having an improved disc arrangement which provides an enhanced level of grinding or deagglomerating capability.

Agitator mills are used generally to disperse solids, such as pigments, in a liquid carrier medium. The dispersion is carried out by grinding and mixing in the chamber of the agitator mill, which includes an agitator shaft that is used to rotate discs or radially extending pegs in order to de-aggregate or de-agglomerate the solids to be dispersed in the liquid. The shaft is generally driven by a mechanical device such as a motor. A grinding media, such as silica or the like, is placed in the agitator mill chamber and is used in connection with the discs or radially extending pegs to disperse the solid material in the liquid. After the grinding and mixing of the solids and liquid is complete, it is necessary to separate the mixture from the grinding media, and then to discharge the mixture from the milling chamber.

One such separator arrangement is described in U.S. Pat. No. 5,333,804, which is assigned to the assignee of the present invention, and is incorporated by reference as if fully set forth. This patent describes a prior known type of disc mill over which the present invention provides improved performance. An example of a known agitator mill utilizing axially extending pins located on the rotor which travel in spaces between fixed pins extending inwardly into the milling chamber is shown in U.S. Pat. No. 4,620,673 which is also incorporated herein by reference as if fully set forth. The two different types of mills (the disc mill and the axially extending pin mill) perform similarly in use.

In prior known disc mills, generally circular mixing discs are mounted on the drive shaft. The discs may be provided with arcuate slots in order to increase the pumping action of the liquid slurry and the grinding media. It has also been known to utilize a solid disc with radially extending bumps that extend from the inner periphery of the disc to the outer periphery in order to increase pumping and the impact force of the grinding media in a mill. Prior mills have also utilized axially and radially spaced apart arms or blades that extend radially from the agitator shaft, with pin-shaped activator elements extending from one or both sides of the arms.

It would be desirable to provide an agitator mill with an improved disc arrangement to improve mill performance in mixing or dispersing solids into a liquid carrier medium, for example by reducing the time required to reduce the particle size of the solid to a desired range and/or by providing the ability to produce a reduced particle size in comparison to the known prior art mills.

SUMMARY

The present invention provides an agitator with a rotatable axial shaft with a plurality of grinding discs connected generally perpendicular to the shaft. At least one grinding disc has an axially extending pin spaced radially outwardly from the shaft and radially inwardly from a peripheral edge of the disc, which is aligned with a smooth surface on a next adjacent disc.

In another aspect, the present invention provides an improved disc for use in connection with an agitator or fine media mill which includes at least one axially extending pin located in proximity to the disc periphery.

BRIEF DESCRIPTION OF THE DRAWINGS

The foregoing summary as well as the following detailed description of the preferred embodiments of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE PREFERRED EMBODIMENTS

Figure 1:
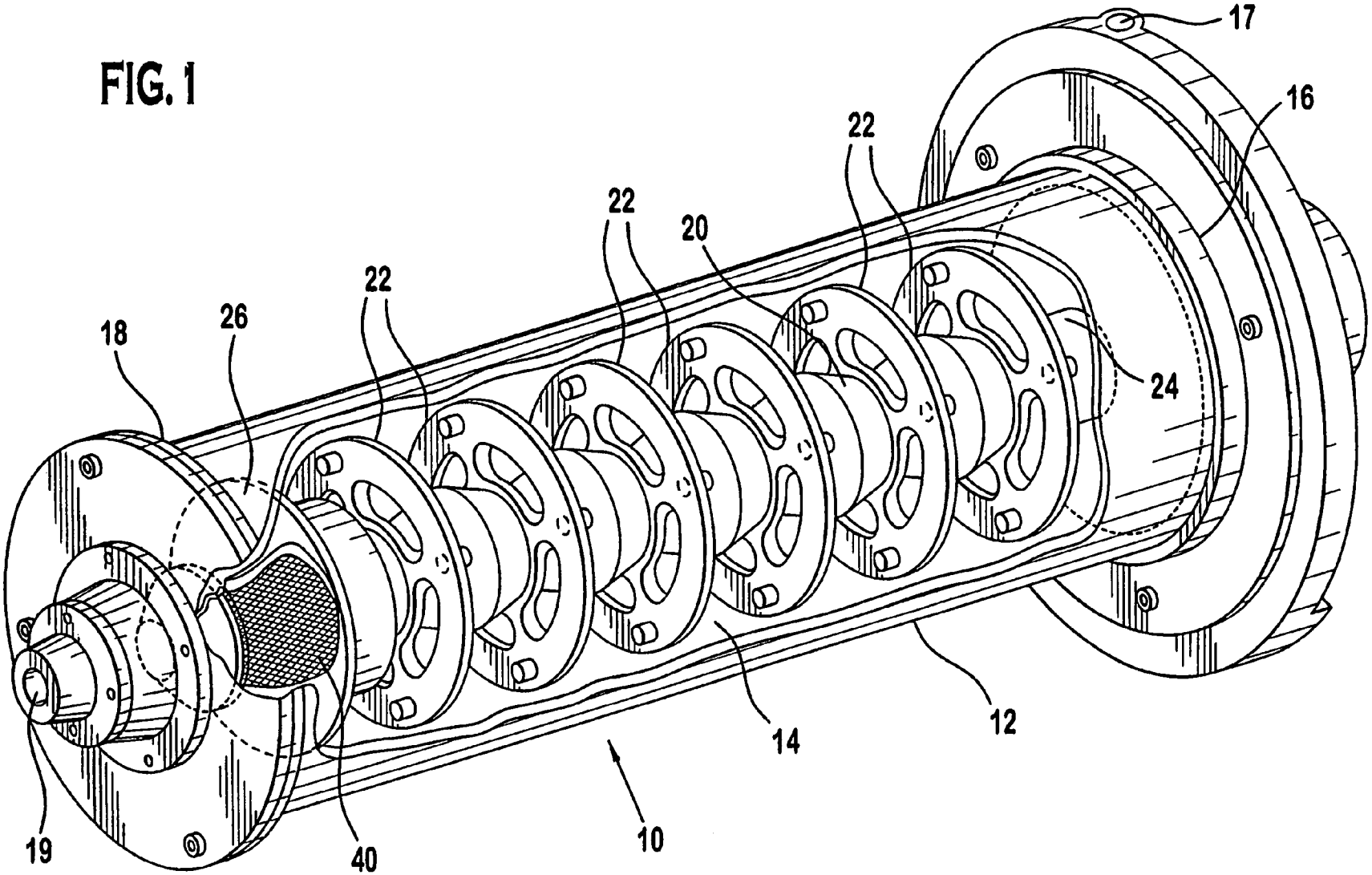
FIG. 1 is a perspective view of an agitator mill constructed in accordance with a preferred embodiment of the present invention, in which the casing has been partially broken away to show the improved disc arrangement in accordance the invention.

Certain terminology is used in the following description for convenience only and is not limiting. The words "right", "left", "lower" and "upper" designate directions in the drawings to which reference is made. The words "inwardly" and "outwardly" refer to directions toward and away from respectively, the geometric center of the media mill and/or the improved disc in accordance with the present invention, and designated parts thereof. The terminology includes the words specifically noted above, derivatives thereof, and words of similar import. In the present application, the terms "a" or "one" are intended to mean at least one unless specifically noted. Additionally, the terms "grinding," "mixing," "deagglomerating" and "dispersing" have been used both singly and in combination to describe the processing of a medium in the mill, and any use of one or more of these terms is intended to include the other terms as well as other descriptions of such processing. The terms "agitator mill" and "fine media mill" are also used to indicate the type of mill that the present invention is directed to, and the use of either term is intended to include both.

Referring now to FIG. 1, there is shown an agitator mill 10 in accordance with a preferred embodiment of the present invention. The agitator mill 10 includes a housing 12 defining an internal milling chamber 14. The housing 12 includes a first end 16 and a second end 18. The housing 12 has been broken away in FIG. 1 to show a plurality of agitator discs 22 in accordance with the present invention which are spaced apart by spacers 20. The discs 22 and spacers 20 are located on an agitator shaft 24 which is rotatably supported at the first end 16 of the housing 12. The agitator shaft 24 is driven to rotate at the desired speed by a motor drive system which is not shown in detail in the present application. The remaining components of a preferred embodiment of the agitator mill 10 are as shown and described in U.S. Pat. No. 5,333,804, which is incorporated herein by reference as if fully set forth. However, it will be recognized by those skilled in the art from the present disclosure that the discs 22 in accordance the present invention can be used in connection with other types of agitator mills and are not limited to use with the preferred agitator mill 10 shown and described. The agitator mill includes a product inlet 17 and a product outlet 19. A separator screen arrangement 40 is located at the second end 18 of the housing 12 in order to prevent the grinding media from exiting the agitator mill 10 along with the product flow.

The number and spacing of the discs 22 and spacers 20 on the agitator shaft 24 can be varied for particular applications, depending upon the solids being deagglomerated or dispersed and the viscosity of the liquid in which the dispersed solids are entrained.

Figures 2, 3, 4:
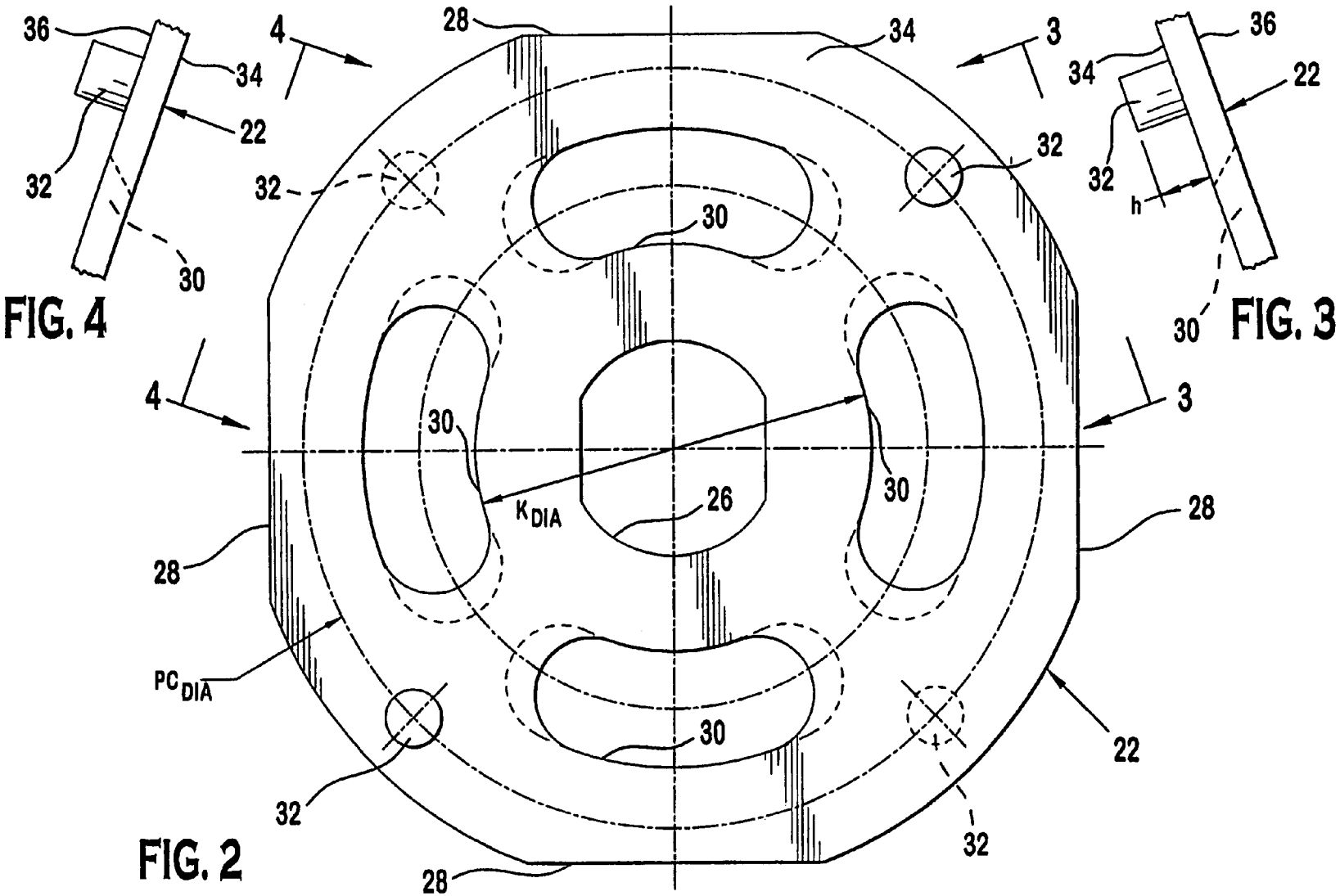
FIG. 2 is a plan view of an improved disc in accordance with the present invention.
FIG. 3 is a side view taken along line 3—3 in FIG. 2.
FIG. 4 is a side view taken along line 4—4 in FIG. 2.
Figure 6:
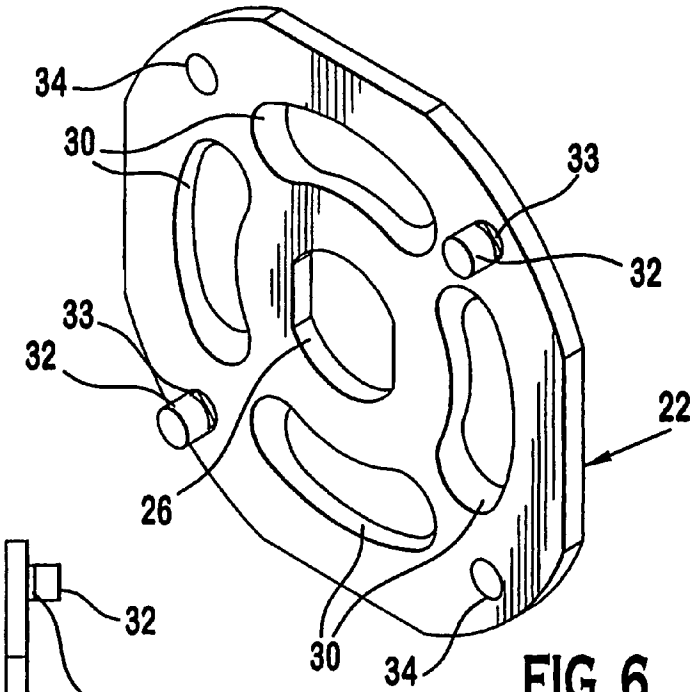
FIG. 6 is a side perspective view of a disc in accordance with a preferred embodiment of the present invention.
Figure 7:
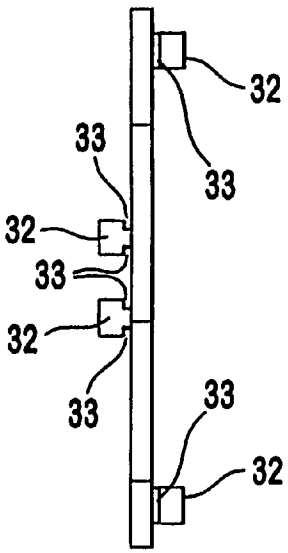
FIG. 7 is a side elevational view of the disc in accordance with a preferred embodiment of the present invention.
Figure 5:
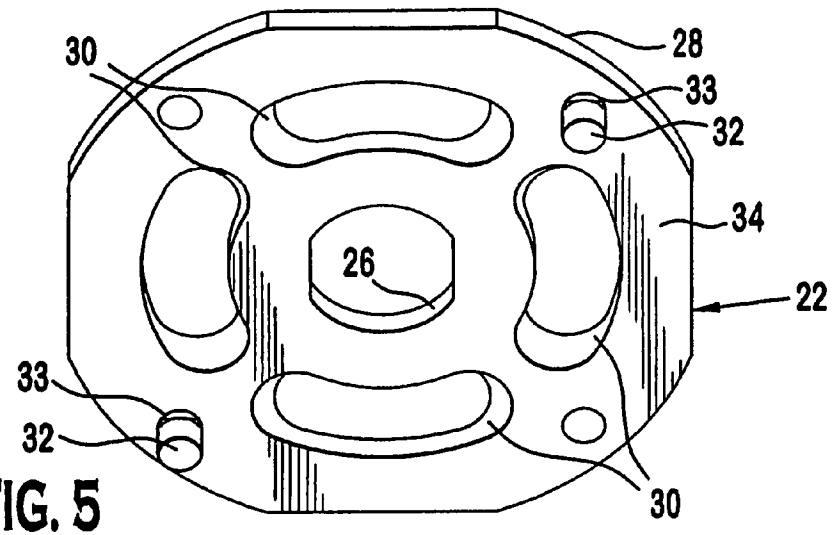
FIG. 5 is a top perspective view of a disc in accordance with a preferred embodiment of the present invention.
Figure 8:
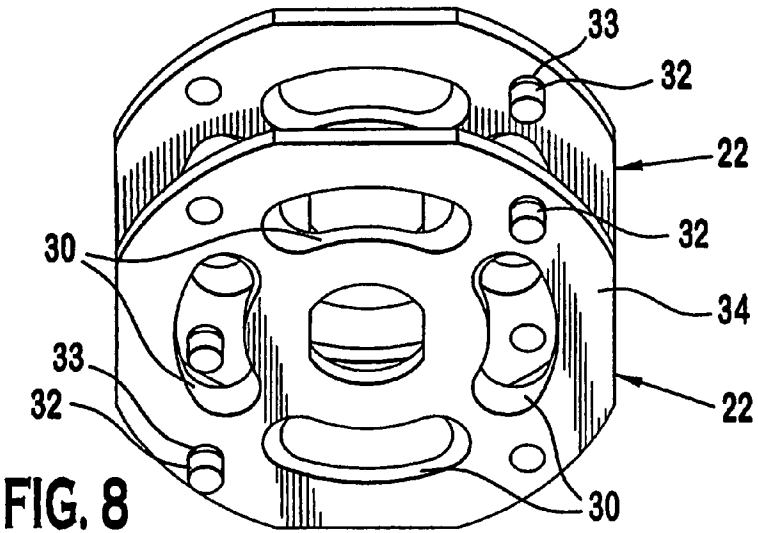
FIG. 8 is a top perspective view showing the arrangement of two discs in accordance with a preferred embodiment of the present invention.
Figure 9:
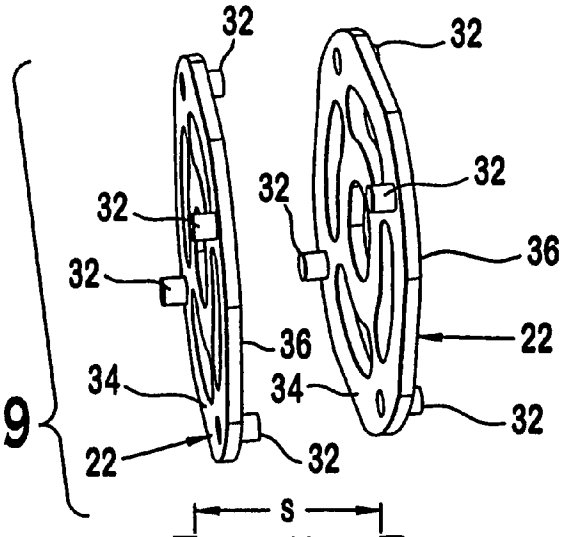
FIG. 9 is a side perspective view showing the arrangement of the two discs in accordance with a preferred embodiment of the present invention shown in FIG. 8.

The discs 22 in accordance with a preferred embodiment of the present invention are shown in detail in FIGS. 2–10. Referring to FIGS. 2–4, preferably each disc 22 includes a central opening 26 which is keyed to fit on the agitator shaft 24 such that each disc 22 rotates with the agitator shaft 24. This can be done by providing flats on the agitator shaft 24 and corresponding flats in the central opening 26. However, those skilled in the art will recognize from the present disclosure that other means may be utilized to connect the discs 22 to the agitator shaft 24, such as a separate notch and key arrangement, if desired. Additionally, the outer periphery 28 of the disc may have various different configurations depending upon the application. For example, one or more flats may be provided on the outer periphery 28 of the disc 22, or the outer periphery 28 of the disc 22 could be provided with other forms, such as teeth, undulations, or other shapes depending upon the mixing characteristics desired.

Preferably, the disc 22 also includes a plurality of arcuate openings or slots 30 to increase the mixing action. In the preferred embodiment, four kidney shaped slots 30 are provided on each disc 22. Preferably, the circumferential ends of each slot 30 are angled as shown in detail in FIGS. 2–4 in order to enhance the pumping action of the discs 22. However, it will be recognized by those skilled in the art from the present disclosure that the shape, size and configuration of the openings 30 may be varied depending the particular application.

As shown in detail in FIGS. 2–7, at least one disc 22, and preferably each disc 22, includes at least one axially extending pin 32 located in proximity to the periphery 28 of the disc 22. In a preferred embodiment, two pins 32 are located on each side of the disc 22, with the two pins on the first side 34 of the disc 22 being spaced approximately 180° apart and the two pins 32 on the second side 36 of the disc 22 also being spaced approximately 180° apart and being offset 90° from the pins 32 on the first side 34. Preferably, the pins 32 are positioned in a disc segment located between the slots 30, and are preferably offset radially outwardly from the outside diameter defined by the slots.

In a preferred embodiment, the pins 32 are approximately cylindrical in shape and are attached in correspondingly located threaded openings in the disc 22. Flats 33 may be provided on opposing sides of the pins 32 for engagement with an installation tool. However, it will be recognized by those skilled in the art from the present disclosure that the shape of the pins 32 can be varied depending upon the particular application. For example, oval-shaped, square or other cross-sectional profiles could be utilized. Additionally, the spacing and number of pins 32 can be varied depending upon the aggressiveness of the mixing action desired. Preferably, the pins 32 are made from tool steel. Those skilled in the art will also recognize from the present disclosure that the pins 32 can be attached to the disc 22 in any suitable manner, such as welding, interference fit, swaging or any other suitable method or may be formed integrally with the disc 22 by machining, casting or any other suitable forming process. The pins 32 are mounted axially such that they are generally parallel to the agitator shaft 24.

In order to achieve optimum de-agglomerating, mixing and/or dispersion during milling, preferably the size and spacing of the pins 32 meet certain criteria based on the size of the mill 10 and discs 22 being utilized. The disc 22 has a predetermined outside diameter based on the size of the mill. The arcuate slots 30 also include an inner slot diameter $K_{DIA}$, shown in FIG. 2. Preferably, the pins 32 have a protrusion height h, shown in FIG. 3, that is in a range of 8% to 15% of a difference between the outside diameter of the disc 22 and $K_{DIA}$. More preferably, the protrusion height h is between 11% and 12% of the difference between the outside diameter of the disc 22 and $K_{DIA}$. The pins 32 also have a diameter that is in a range of approximately 90% to 110% of the protrusion height h, and more preferably is in the range of 105% to 107% of the protrusion height.

Figure 10:
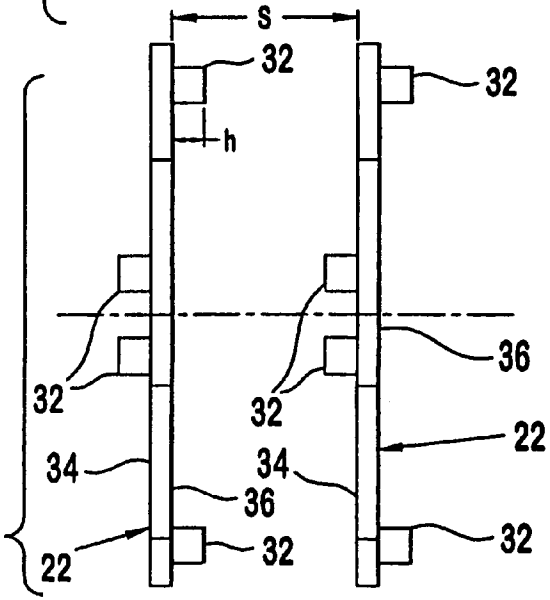
FIG. 10 is a side elevational view of the two discs shown in FIG. 9.

The pins 32 are preferably located on a pin circle having a diameter $PC_{DIA}$ that is in a range of 75% to 90% of the outside diameter of the disc 22, and more preferably $PC_{DIA}$ is in the range of 85% to 87% of the disc o.d. in order to achieve optimum performance. Additionally, the distance S between adjacent discs 22, as shown in FIG. 10, is in a range of approximately 210% to 530% of the pin protrusion height h.

In one preferred embodiment for a disc 22 having an outside diameter of approximately 9.54 inches and $K_{DIA}$ of 4.44 in., the pins 32 have a protrusion height of approximately 0.59 in. and are approximately ⅝ in. in diameter. $PC_{DIA}$ is approximately 8.2 inches and the spacing between adjacent discs 22 is in the range of 1.5 to 2 inches. Those skilled in the art will recognize that the above-noted dimensions are intended to be merely exemplary, and that other dimensions could be utilized. Preferably, other selected dimensions will meet the criteria set forth above in order to achieve optimum performance.

As shown in detail in FIGS. 1 and 8–10, the location of the pins 32 on the neighboring discs 22 are also shown. In accordance with the present invention, the at least one pin 32 on the disc 22 is located in a complementary position to a smooth surface on the neighboring or next adjacent disc 22. While in the preferred embodiment pins 32 extend from both surfaces 34, 36 of each disc 22, it will be recognized by those skilled in the art from the present disclosure that a pin 32 may extend only from one surface 34, 36, of a given disc 22 and that the position of the pin 32 is aligned with a smooth area on a neighboring or next adjacent disc 22. It is also possible that the neighboring disc may be designed such that it does not include any pins 32 such that only every other disc 22 in the agitator mill 10 includes any pins 32. However, in the preferred embodiment, the pins 32 on each disc 22 are aligned such that the pins 32 on the first face 34 of each disc 22 are generally aligned with one another, and the pins 32 on the second face 36 of each disc are also aligned, as shown.

Figure 11:
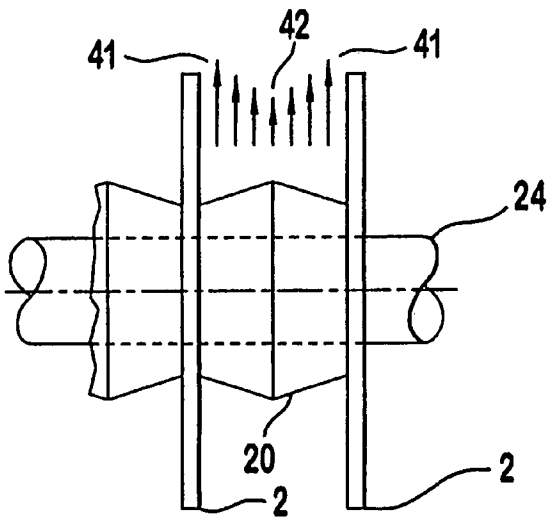
FIG. 11 PRIOR ART
FIG. 11 is a side elevational view showing a velocity profile in a fine media mill with the known prior art discs.
Figure 12:
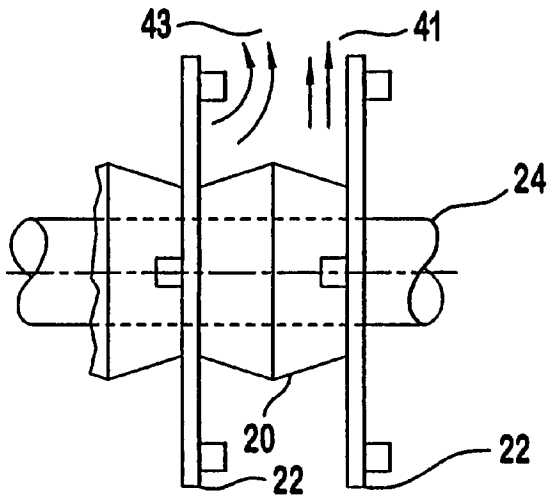
FIG. 12 is a side elevational view showing a velocity profile illustrating the flow disruption created by the discs in accordance with the present invention.

The unique positioning of the pins 32 results in a greatly enhanced level of de-agglomerating, mixing and/or dispersion capability by forcing the pins 32 through the normal accelerating flow of the media/product mixture in the agitator mill 10. The forcing action results in a diverting of the product flow around the parallel pins 32 as illustrated diagrammatically in FIG. 12. The prior art arrangement of discs 2 without the pins 32 is shown in FIG. 11 in which the velocity profile is generally highest at the surfaces of the discs (as represented by the longer arrows 41) and lowest in an area midway between the discs (as indicated by the shortest arrow 42). In comparison, the velocity profile shown in FIG. 12 illustrates how the pins 32 divert the product flow around the pins 32 which eliminates the low velocity segment of the flow profile and causes a higher velocity as represented by arrows 43. This forcing action creates a disruption in the flow across the first and second disc surfaces 34, 36 which are generally flat, and results in a pulsating flow pattern towards and away from the disc surface. This combined action increases the velocity of the media/product mixture as it flows around each pin 32, increasing the velocity beyond that normally obtained at the disc periphery 28. The result is believed to be an increase in the maximum shear level attainable at a given agitator tip speed beyond that attainable with the conventional disc arrangement or the prior known axial pin agitation systems operated under the same conditions.

Figure 13:
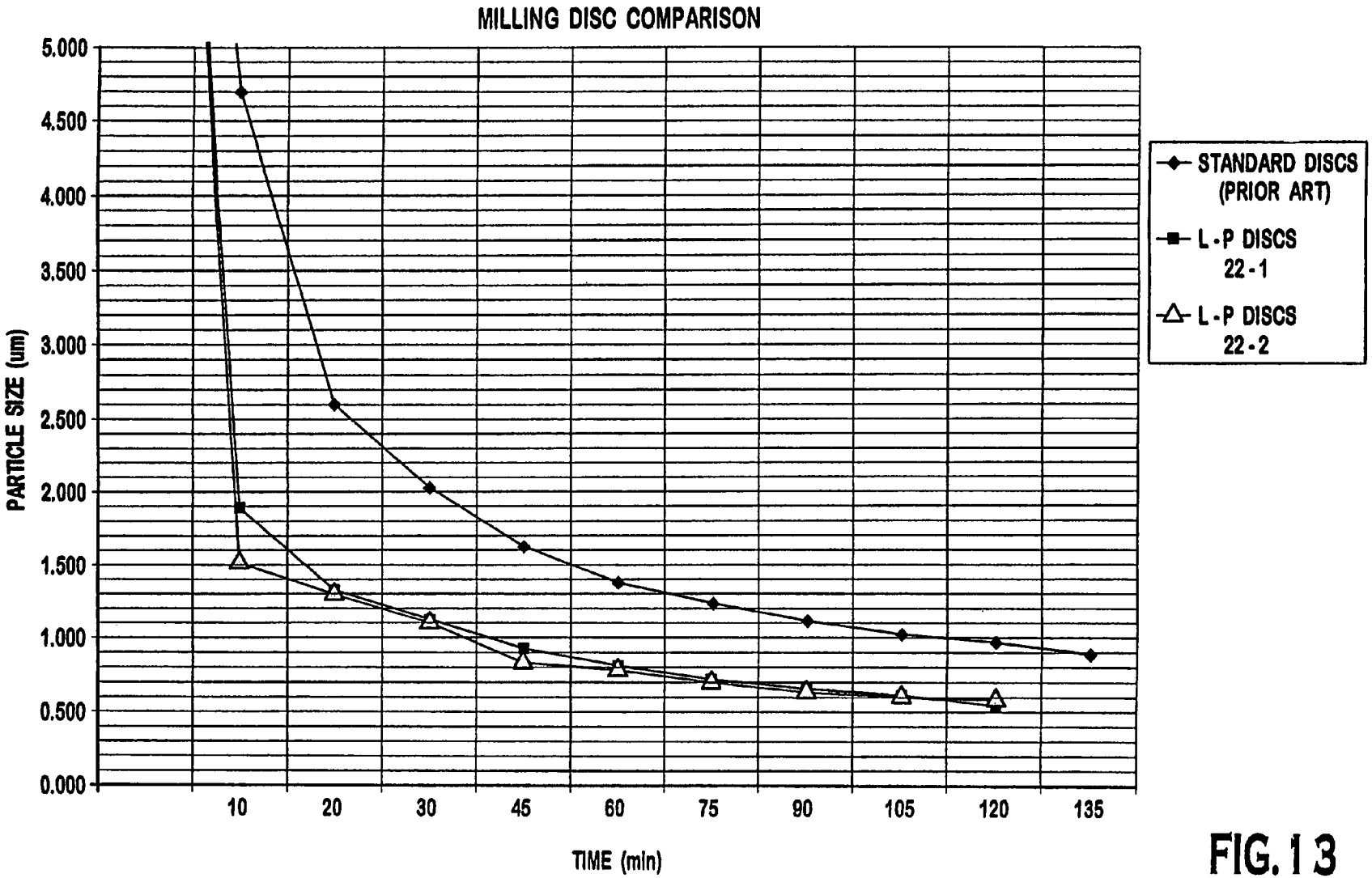
FIG. 13 is a milling disc comparison chart illustrating the increase in particle size reduction provided by the discs in accordance with the present invention in comparison to the known prior art discs.

The higher media/product shear level obtained with this unique pin disc 22 utilized in the agitator mill 10 results in a significant and substantial increase in the rate of product dispersion when compared with the existing convention discs systems. Test data shown in FIG. 13, which compares a prior art disc with two separate tests of discs 22 with pins 32 in accordance with the present invention (designated 22-1 and 22-2) shows an increase in de-agglomeration, mixing and/or dispersion capacities of 150–300% from those achieved in an agitator mill 10 having conventional discs operated under identical process conditions. As shown in FIG. 13, after 10 minutes of operation with a standard disc, the average particle was approximately 4.7 μm. In comparison, with the disc 22 having the pins 32 in accordance with the preferred embodiment of the present invention as described above, after 10 minutes the particle size was approximately 1.8 μm in Test 1 and approximately 1.5 μm in Test 2.

In the known agitator mill using discs without the axial pins 32, the agitator mill is limited to a maximum $Q_{max}$ value which indicates a best achievable product dispersion as indicated by a minimum particle size after mixing to a point where further reduction in particle size is non-attainable. This would be represented by a horizontal line in FIG. 13 which would be generally asymptotic to the performance curve to indicate the minimum particle size. By utilizing the improved disc 22 with the pins 32 in accordance with the present invention, the $Q_{max}$ value for a given agitator mill has changed and is a significant improvement over the prior known mills. This means that an agitator mill 10 equipped with the discs 22 with pins 32 in accordance with the present invention can obtain a higher operating efficiency with no other change to the equipment aside from the configuration of the discs 22 in order to produce the same particle size, and can also be used to generate an even smaller particle size than was previously attainable.

While the preferred embodiment of the present invention has been described in detail, those skilled in the part will recognize that other arrangements and instrumentalities can be used within the scope and spirit of the present invention. It is believed that the unique positioning of an axially extending pin located in proximity to the periphery of the disc and facing a smooth surface on the next adjacent or neighboring disc has provided this improvement over the prior known system. The discs 22 in accordance with the present invention having pins 32 can also be retrofitted onto existing equipment by replacement of one or more of the existing discs with discs 22 in accordance with the present invention. Accordingly, this invention is not limited to the precise arrangement shown but rather to the general concept of utilizing an axially extending pin on one disc 22 which extends toward a smooth surface of the neighboring or next adjacent disc.

What is claimed is:

1. An agitator mill for grinding a product, comprising:

a rotatable axial shaft;

a first grinding disc having a peripheral edge and an outer diameter connected to said shaft in a generally perpendicular orientation, wherein said first grinding disc comprises a first axially extending pin positioned radially outward from said rotatable shaft and radially inward from said peripheral edge of said first grinding disc;

a second grinding disc having a peripheral edge connected to said shaft in a generally perpendicular orientation at a spaced apart distance from said first grinding disc; and grinding media that grinds the product, wherein said first axially extending pin is aligned with a smooth surface of said second grinding disc.

2. The agitator mill according to claim 1, wherein said first grinding disc further comprises a plurality of slots each positioned radially outward from said rotatable shaft and radially inward from said peripheral edge of said first grinding disc, wherein said axially extending pin is located in a disc segment between said plurality of slots.

3. The agitator mill according to claim 2, wherein said first grinding disc has a center and an outer periphery and said plurality of slots that are positioned equidistant from said center to form a slot circle having an inner diameter and an outer diameter.

4. The agitator mill according to claim 3, wherein said plurality of slots are three slots.

5. The agitator mill according to claim 3, wherein said plurality of slots are four slots.

6. The agitator mill according to claim 4, wherein said three slots are kidney shaped.

7. The agitator mill according to claim 4, wherein said axially extending pins are located closer to the outer periphery than the center.

8. The agitator mill according to claim 4, wherein said first grinding disc further comprises second, third and fourth axially extending pins, wherein said first and second axially extending pins are located on a first side of said grinding disc and are spaced approximately 180 degrees apart and said third and fourth pin are located on a second, opposite side of said first grinding disc and are spaced approximately 180 degrees apart and wherein said third pin is offset about 90 degrees from said first pin and said fourth pin is offset about 90 degrees from said second pin.

9. The agitator mill according to claim 8, wherein each of said first, second, third, and fourth axially extending pins are positioned on a disc segment located between one of the at least first, second and third slots, and each of said axially extending pins are offset radially outwardly from the outside diameter defined by said slots.

10. An agitator mill according to claim 8, wherein said first, second, third and fourth axial pins are positioned equidistant from the center and define a circular path along the first and second sides of said first grinding disc.

11. The agitator mill according to claim 10, wherein said circular path has a diameter ranging from approximately 75% to approximately 90% of the outer diameter of the disc.

12. The agitator mill according to claim 11, wherein said circular path diameter ranges from approximately 85% to approximately 87% of the outer diameter of the disc.

13. The agitator mill according to claim 8, wherein said axially extending pins each have a protrusion height that ranges from approximately 8% to approximately 15% of a difference between the outer diameter of the disc and the inner diameter of the slot circle.

14. The agitator mill according to claim 13, wherein the protrusion height ranges from approximately 11% to approximately 12% of the difference between the outer diameter of the first grinding disc and inner diameter of the slot circle.

15. The agitator mill according to claim 13, wherein said axially extending pins have a diameter ranging from approximately 90% to approximately 110% of the protrusion height.

16. The agitator mill according to claim 15, wherein said axially extending pins has a diameter that ranges from approximately 105% to approximately 107% of the protrusion height.

17. An agitator mill for grinding a product, comprising:

a housing having a first end and a second end;

a rotatable axial shaft disposed within said housing that extends at least partially between said first end and said second end;

a first grinding disc having a peripheral edge and an outer diameter connected to said shaft in a generally perpendicular orientation, wherein said first grinding disc comprises a first axially extending pin positioned radially outward from said rotatable shaft and radially inward from said peripheral edge of said first grinding disc;

a second grinding disc having a peripheral edge connected to said shaft in a generally perpendicular orientation at a spaced apart distance from said first grinding disc; and grinding media that grinds the product disposed within said housing, wherein said first axially extending pin is aligned with a smooth surface of said second grinding disc.

18. The agitator mill according to claim 17, wherein said first grinding disc further comprises a plurality of slots each positioned radially outward from said rotatable shaft and radially inward from said peripheral edge of said first grinding disc, wherein said axially extending pin is located in a disc segment between said plurality of slots.

19. The agitator mill according to claim 18, wherein said first grinding disc has a center and an outer periphery and said plurality of slots that are positioned equidistant from said center to form a slot circle having an inner diameter and an outer diameter.

20. The agitator mill according to claim 19, wherein said plurality of slots are four slots.

21. The agitator mill according to claim 20, wherein said four slots are kidney shaped.

22. The agitator mill according to claim 20, wherein said axially extending pins are located closer to the outer periphery than the center.

23. The agitator mill according to claim 20, wherein said first grinding disc further comprises second, third and fourth axially extending pins, wherein said first and second axially extending pins are located on a first side of said grinding disc and are spaced approximately 180 degrees apart and said third and fourth pins are located on a second, opposite side of said first grinding disc and are spaced approximately 180 degrees apart and wherein said third pin is offset about 90 degrees from said first pin and said fourth pin is offset about 90 degrees from said second pin.

24. The agitator mill according to claim 23, wherein each of said first, second, third, and fourth axially extending pins are positioned on a disc segment located between one of the at least first, second, third, and fourth slots, and each of said axially extending pins is offset radially outwardly from the outside diameter defined by said slots.

25. An agitator mill according to claim 23, wherein said first, second, third and fourth axial pins are positioned equidistant from the center and define a circular path along the first and second sides of said first grinding disc.

26. A method for mixing or grinding a product in a mill having a rotatable shaft, comprising:

combining the product with a grinding media to form a product-media mixture;

passing the product-media mixture through the mill;

rotating a plurality of grinding discs connected to the rotatable shaft, wherein at least one of the grinding discs has first, second, third and fourth axially extending pins located on the at least one grinding disc, wherein the first and second axially extending pins extend from a first side of the at least one disc, and wherein the third and fourth axially extending pins extend from a second side of the at least one disc, wherein the first and second axially extending pins are spaced apart radially approximately 180°, and the third and fourth axially extending pins are spaced apart radially approximately 180°, and are offset from the first and second axially extending pins by approximately 90°, and wherein the axially extending pins being located in a radial position between four elongate arcuate slots; and discharging the product from the mill.

27. A grinding disc for use with an agitator mill that agitates and grinds a product, comprising:

a peripheral edge;

a central opening for attachment to a rotatable shaft;

an outer diameter;

a first axially extending pin positioned radially outward from said central opening and radially inward from said peripheral edge of the grinding disc;

a second axially extending pin positioned radially outward from said central opening and radially inward from said peripheral edge of the grinding disc, wherein said second axially extending pin is spaced approximately 180 degrees apart from said first axially extending pin; and a plurality of slots each positioned radially outward from said central opening and radially inward from said peripheral edge of the disc, wherein said first and second axially extending pins are located in a disc segment between said plurality of slots, wherein said first axially extending pin and said second axially extending pin combine with a grinding media to grind the product.

* * * * *

UNITED STATES PATENT AND TRADEMARK OFFICE

CERTIFICATE OF CORRECTION

PATENT NO. : 7,073,738 B2
APPLICATION NO. : 10/913423
DATED : July 11, 2006
INVENTOR(S) : John R. Sneeringer et al.

It is certified that error appears in the above-identified patent and that said Letters Patent is hereby corrected as shown below:

On the title page:
Item (75), Inventors:

Please replace "MacNeall" with --MacNeill--;

Column 7

Line 4, please replace "pin" with --pins--.

Signed and Sealed this

Fifth Day of September, 2006

JON W. DUDAS
*Director of the United States Patent and Trademark Office*